US005551097A

United States Patent [19]

Short

[11] Patent Number: 5,551,097

[45] Date of Patent: Sep. 3, 1996

[54] COMPACT URINAL SYSTEM

[75] Inventor: Johnny W. Short, 309 Forest Rd. West, Wilson, N.C. 27893

[73] Assignees: Johnny W. Short; L. Ralph Jones, both of Wilson, N.C.; a part interest

[21] Appl. No.: 397,849

[22] Filed: Mar. 2, 1995

[51] Int. Cl.[6] ..... E03D 13/00; E03D 5/01

[52] U.S. Cl. ..... 4/301; 4/321; 4/144.1

[58] Field of Search ..... 4/144.1, 144.2, 4/144.3, 262, 301, 309, 311, 321, 323

[56] References Cited

U.S. PATENT DOCUMENTS

| | | | |
|---|---|---|---|
| 2,582,398 | 1/1952 | Siegenthal | 4/144.3 X |
| 2,696,012 | 12/1954 | Hahn | 4/323 |
| 2,761,149 | 9/1956 | Kay | 4/321 X |
| 3,533,109 | 10/1970 | Kishimoto | 4/144.1 X |
| 3,609,772 | 10/1971 | Howard | 4/321 |
| 3,757,355 | 9/1973 | Allen et al. | 4/301 X |
| 4,137,579 | 2/1979 | Soler | 4/311 |
| 4,345,342 | 8/1982 | Saito | 4/301 |
| 4,490,863 | 1/1985 | Pate | 4/301 |

FOREIGN PATENT DOCUMENTS

| | | | |
|---|---|---|---|
| 1485683 | 6/1967 | France | 4/301 |
| 2062473 | 5/1981 | United Kingdom | 4/144.1 |

*Primary Examiner*—Robert M. Fetsuga
*Attorney, Agent, or Firm*—Rhodes, Coats & Bennett, L.L.P.

[57] ABSTRACT

A sanitary, compact urinal system is provided that can be used in confined spaces such as in trucks, boats, planes, and the like. Other applications may be found in nursing homes, hospitals, and other medical facilities. The system includes a flushing tank for storing a flushing fluid and a remote receptacle head for receiving urine from a user. A pump, which is actuated by a switch mounted on the receptacle head, pumps flushing fluid through a flushing line from the flushing tank into the receptacle head. A waste line drains urine and flushing fluid from the receptacle head into a waste tank, which may be housed with the flushing tank in a single, portable tank unit. The receptacle head is preferably composed of a clear material to enhance visibility and includes an illuminating device as well as indicators to indicate fluid level in the tanks. Additionally, a second receptacle head may also be provided for the system.

18 Claims, 5 Drawing Sheets

COMPACT URINAL SYSTEM

FIELD OF THE INVENTION

The present invention pertains to a urinal and particularly pertains to a compact, portable, self-contained, flushing urinal system that may be used in, for example, trucks, boats, and aircraft.

BACKGROUND OF THE INVENTION

An ever-present problem in many vehicles and other relatively small places is the lack of adequate toilet facilities. For example, a common problem among members of the trucking industry is the lack of a urinal in the sleeper compartment of a transfer truck cab. Oftentimes, truckers sleep in their trucks at rest stops or during alternating driving shifts while on the road. Such sleep is essential for safe, alert driving, yet sleep is often disturbed by a trucker having to leave the truck to urinate in a toilet in a rest area or other facility. Because sleeper compartments are designed to be completely dark to aid sound sleeping, a venture outside the truck to use the toilet usually jolts a trucker awake and greatly interrupts sleep.

To avoid sleep disturbance problems and the associated inconveniences of having to leave a truck to urinate, many truckers prefer to urinate in a jar or similar container for later disposal during waking hours. However, this approach to relieving oneself is fraught with problems as well. In addition to the obvious sanitation problems, such an approach to mid-sleep urination often unduly awakens a trucker because of the need to turn on a bright light in the truck's sleeper compartment to avoid a mishap.

Similar problems regarding urination occur in a wide range of other situations involving lengthy confinement, such as in boats or small aircraft. While the need for the least possible interruption of sleep may not be as relevant in such situations, the need to urinate comfortably and sanitarily is an ever-present concern when a person is confined in a place without conventional toilet facilities. Therefore, a need exists for a compact urinal system, which can be either portable or permanently installed in truck sleeper compartments, boats, small aircraft, etc., that is sanitary and lends itself to neat, convenient use. Especially with regard to truck sleeper compartments, it is particularly important that there be a urinal system that can be used without a need for bright, awakening lights.

SUMMARY AND OBJECTS OF THE INVENTION

The present invention provides a sanitary, compact urinal system that can be used in trucks, boats, planes, and the like to alleviate problems associated with leaving the confinement of the vehicle to urinate. In the disclosed embodiment, the system includes a flushing tank for storing a flushing fluid and a remote receptacle head for receiving urine from a user of the system. A pump, which is actuated by a switch mounted on the receptacle head, pumps flushing fluid through a flushing line from the flushing tank into the receptacle head. A waste line drains urine and flushing fluid from the receptacle head into a waste tank, which may be housed with the flushing tank in a single, portable tank unit.

To enable a sleepy user to see well enough to urinate, yet not be completely awakened by bright light, the receptacle head includes an illuminating device that casts a dim light about the receptacle head, which is preferably composed of a clear material to enhance visibility. To prevent spills during urination and flushing thereafter, a handle is provided on the receptacle head and a fitted cap is provided that can be snapped over the inlet end of the receptacle head. Indicators on the receptacle head indicate fluid levels in the tanks. In certain situations, it may also be desirable to provide a second receptacle head for the system.

It is therefore an object of the present invention to provide a self-contained, sanitary, compact urinal system that is adapted to fit temporarily or permanently in a confined area such as a truck sleeper compartment.

Another object of the present invention is to provide a compact urinal system that includes a flushing tank for holding a flushing fluid, at least one remote, hand-held urine receptacle head for receiving urine, and a waste tank for holding used flushing fluid and urine.

Another object of the present invention is to provide a compact urinal system wherein the hand-held receptacle head includes a switch for actuating a pump, which pumps flushing fluid from the flushing tank through a flushing line and into the receptacle head to flush urine down a waste line into the waste tank.

Another object of the present invention is to provide a compact urinal system wherein the hand-held receptacle head is composed of a transparent material and includes an illuminating device for use in a dark environment.

Another object of the present invention is to provide a compact urinal system wherein the hand-held receptacle head includes indicators for indicating the level of fluid in the flushing tank and in the waste tank.

Other objects and advantages of the present invention will become apparent and obvious from a study of the following description and the accompanying drawings, which are merely illustrative of such invention.

DETAILED DESCRIPTION OF THE INVENTION

To alleviate problems associated with the lack of adequate urinal facilities in confined areas where it is inconvenient to leave to use a conventional toilet, the present invention provides a sanitary, compact, flushing-type urinal system, generally indicated by the numeral 10. The compact urinal system 10 may be temporarily or permanently installed in, for example, a transfer truck sleeper compartment, a boat, or a small aircraft. Other applications of the system 10 could include use as a portable urinating device, replacing bedpans in nursing homes, hospitals, or other health care facilities.

Figure 1:
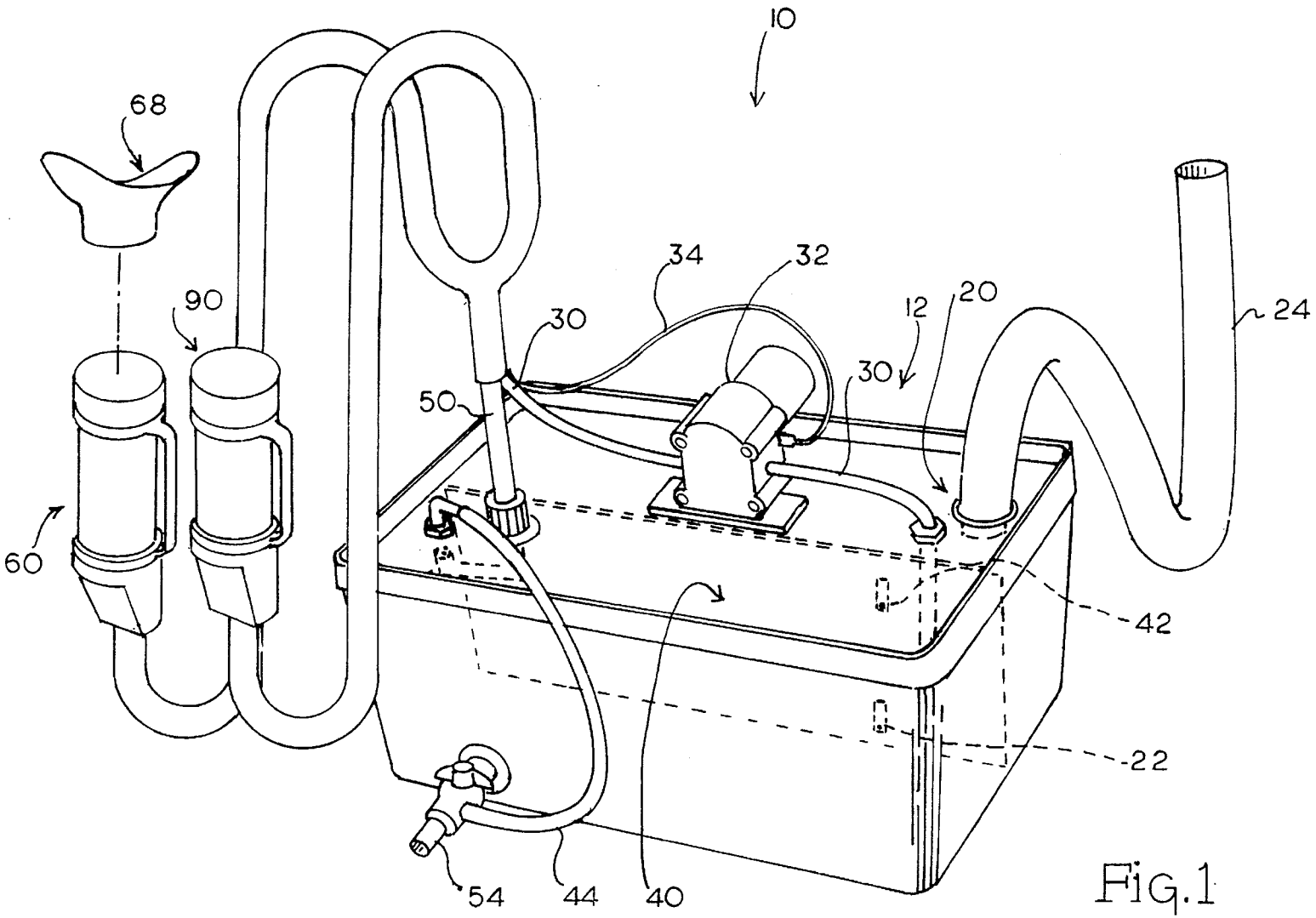
FIG. 1 is a perspective view of the compact urinal system of the invention.

In the embodiment shown in the drawings, particularly FIG. 1, the compact urinal system 10 of the invention includes a flushing tank 20 and a waste tank 40 housed together into a single tank unit 12. To allow easy transportability, a handle may be provided on the tank unit 12. Remote from the tank unit 12 is a hand-held urine receptacle head, generally indicated by the numeral 60, connected to the tank unit 12 by a flushing line 30 leading from the flushing tank 20 and by a waste line 50 leading to the waste tank 40. FIG. 1 shows an embodiment of the system 10 having a second urine receptacle head 90, although depending on a particular application, one receptacle head may be sufficient. For purposes of simplicity, this description will primarily refer to only one receptacle head 60.

Figure 2:
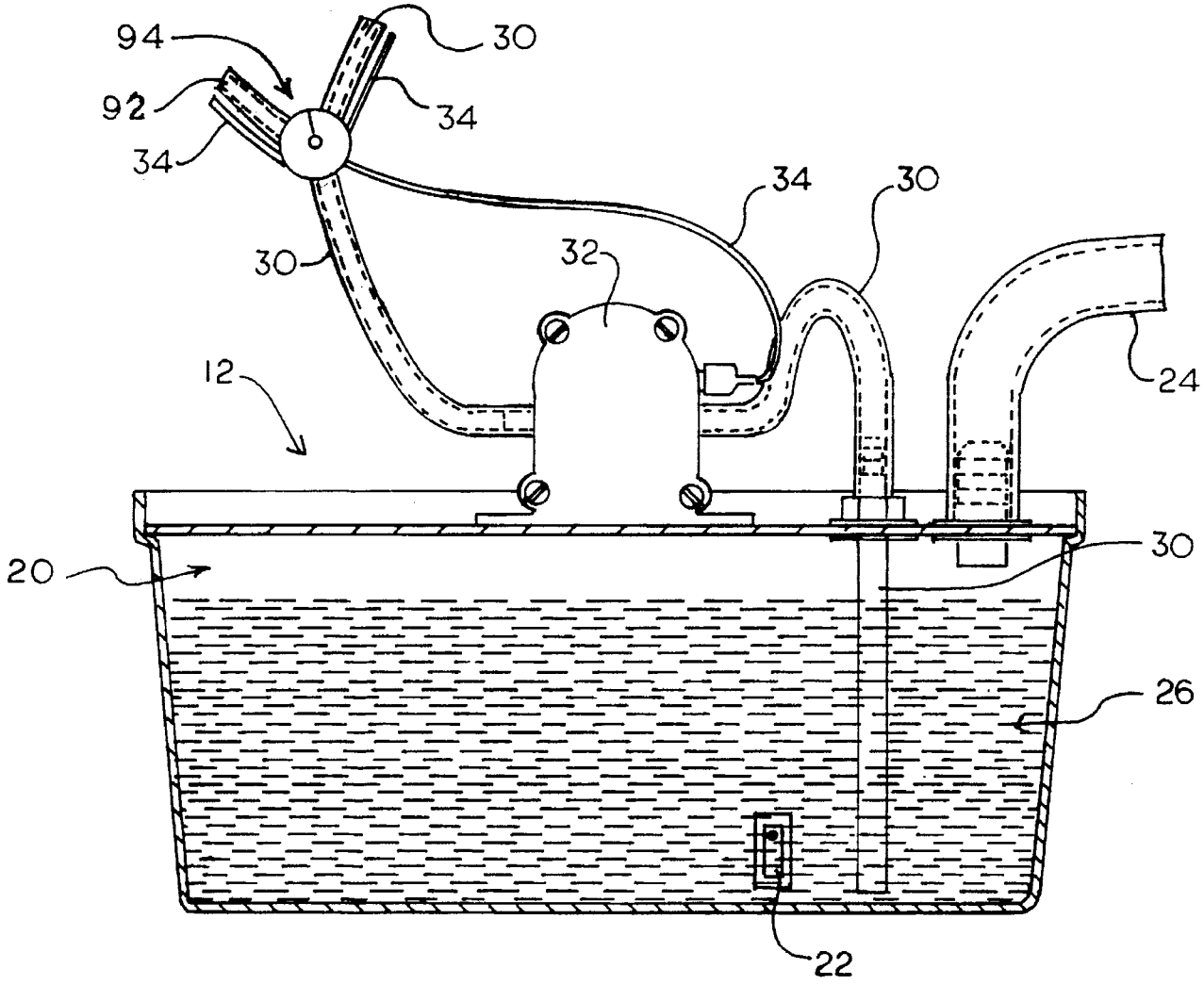
FIG. 2 is a transverse cross-section view through the flushing tank of the compact urinal.

As shown in FIG. 2, the flushing tank 20 stores a conventional disinfecting and deodorizing flushing fluid 26, which is introduced into the flushing tank 20 through a fill hose 24. The fill hose 24 also serves as a vent to allow for the displacement of flushing fluid 26 by air during flushing of the system 10. A float switch 22 measures the level of flushing fluid 26 and sends a signal to a fluid level indicator when the volume of flushing fluid drops below a certain level. The flushing line 30 is open to the bottom of the flushing tank 20 and extends up through the top of the flushing tank 20 into a pump 32, which in this embodiment is mounted atop the flushing tank 20. After emerging from the pump 32, the flushing line 30 is preferably composed of a flexible material so that the receptacle head 60 can be freely moved into any desired position.

Figure 3:
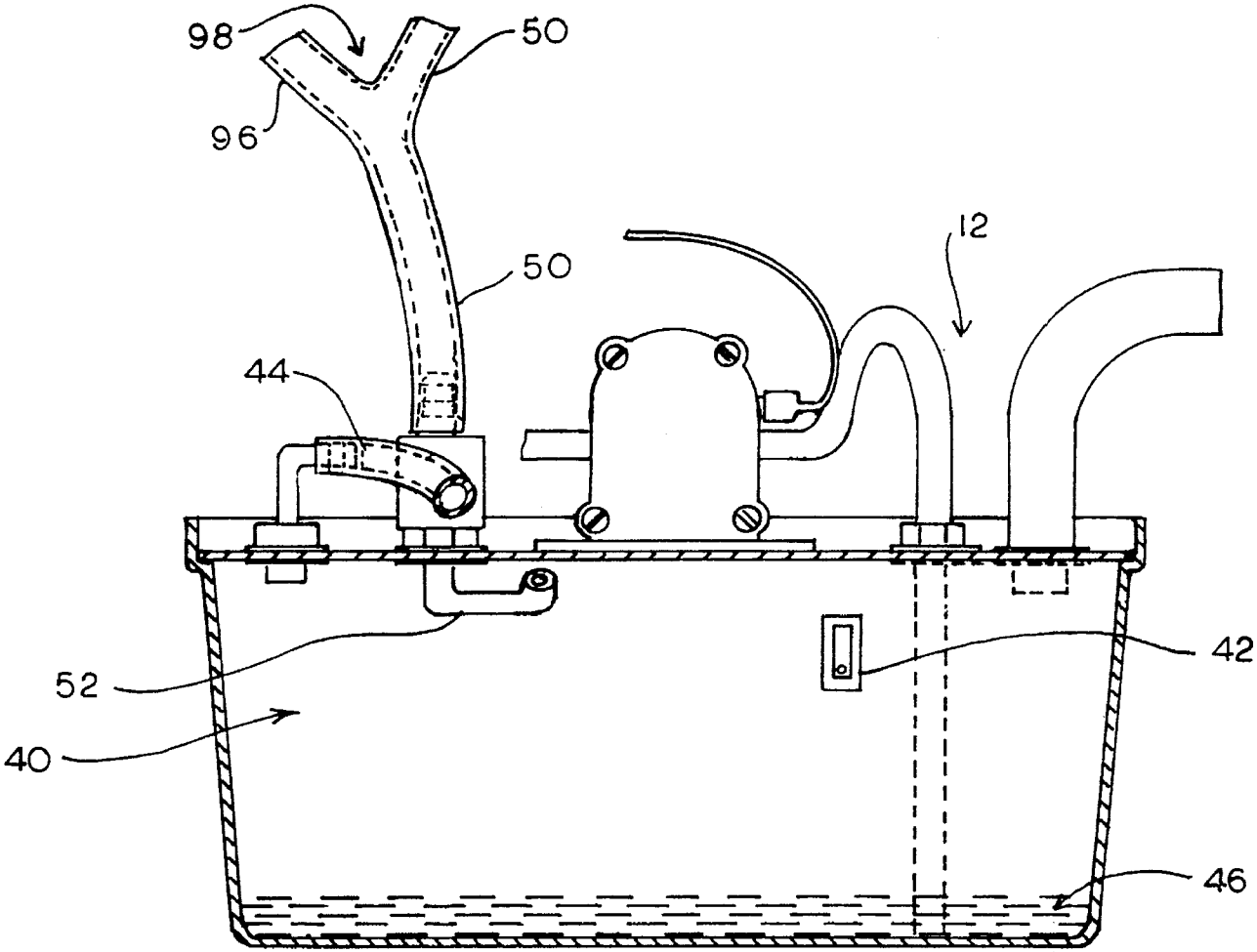
FIG. 3 is a transverse sectional view through the waste tank of the compact urinal.

FIG. 3 shows the waste tank 40 partially filled with used flushing fluid and urine 46. Waste 46 drains from the receptacle head 60 through waste line 50 into the waste tank 40. To prevent foul, pungent odors from escaping out the receptacle head 60 from the waste tank 40, a P-trap 52 is provided at the outlet end of the waste line 50, which is disposed near the top of the waste tank 40. A float switch 42 measures the level of waste 46 and sends a signal to a waste level indicator when the volume of waste reaches a certain level. When the waste tank 40 becomes full, waste 46 may be emptied from the waste tank 40 out drain line 54, seen in FIG. 1. To ensure proper venting during flushing of the system 10 and emptying of the waste tank 40, a vent hose 44 is provided that runs from the top of the waste tank 40 into the drain line 54.

Figure 4:
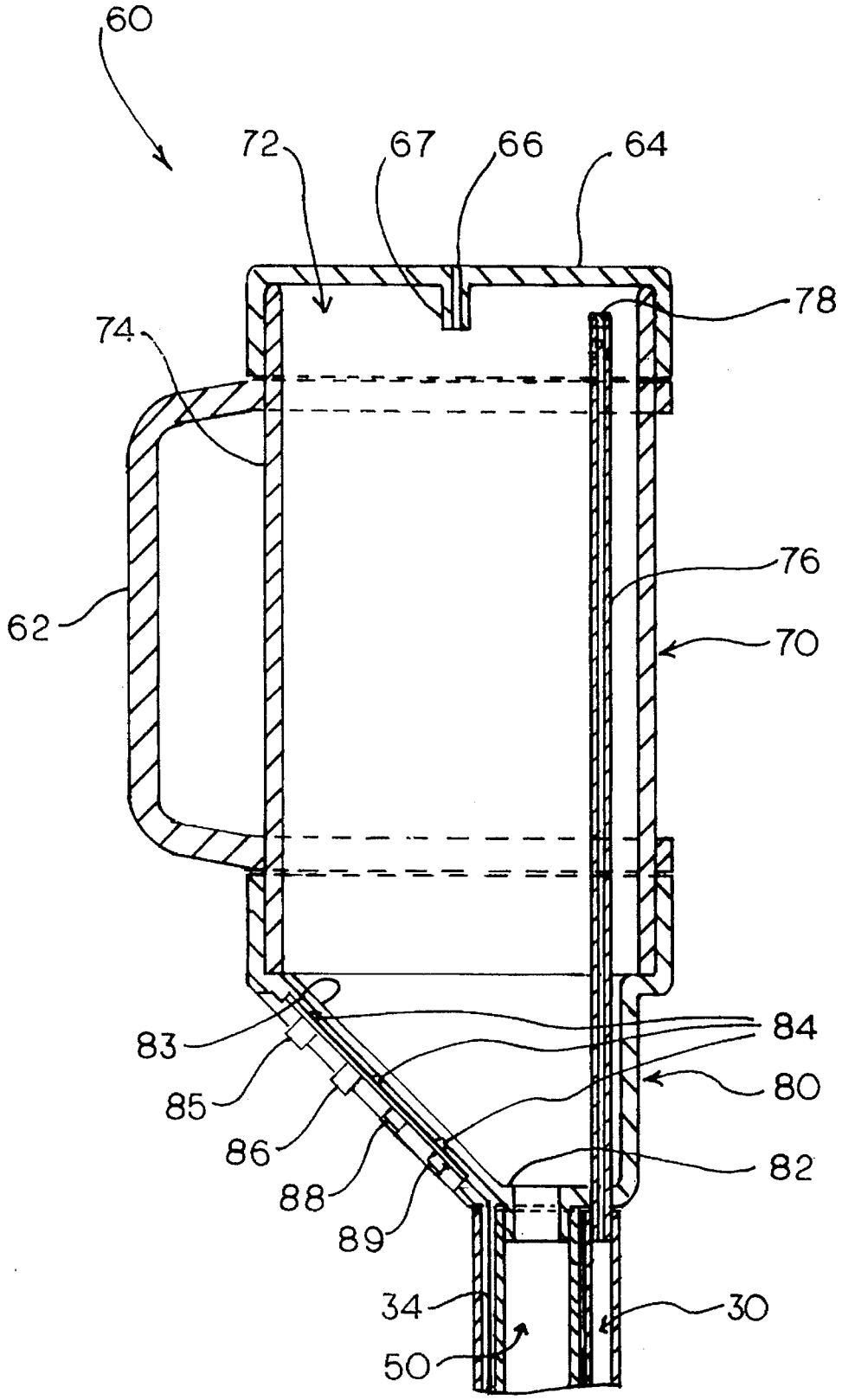
FIG. 4 is a cross-sectional depiction of a urine receptacle head.
Figure 5:
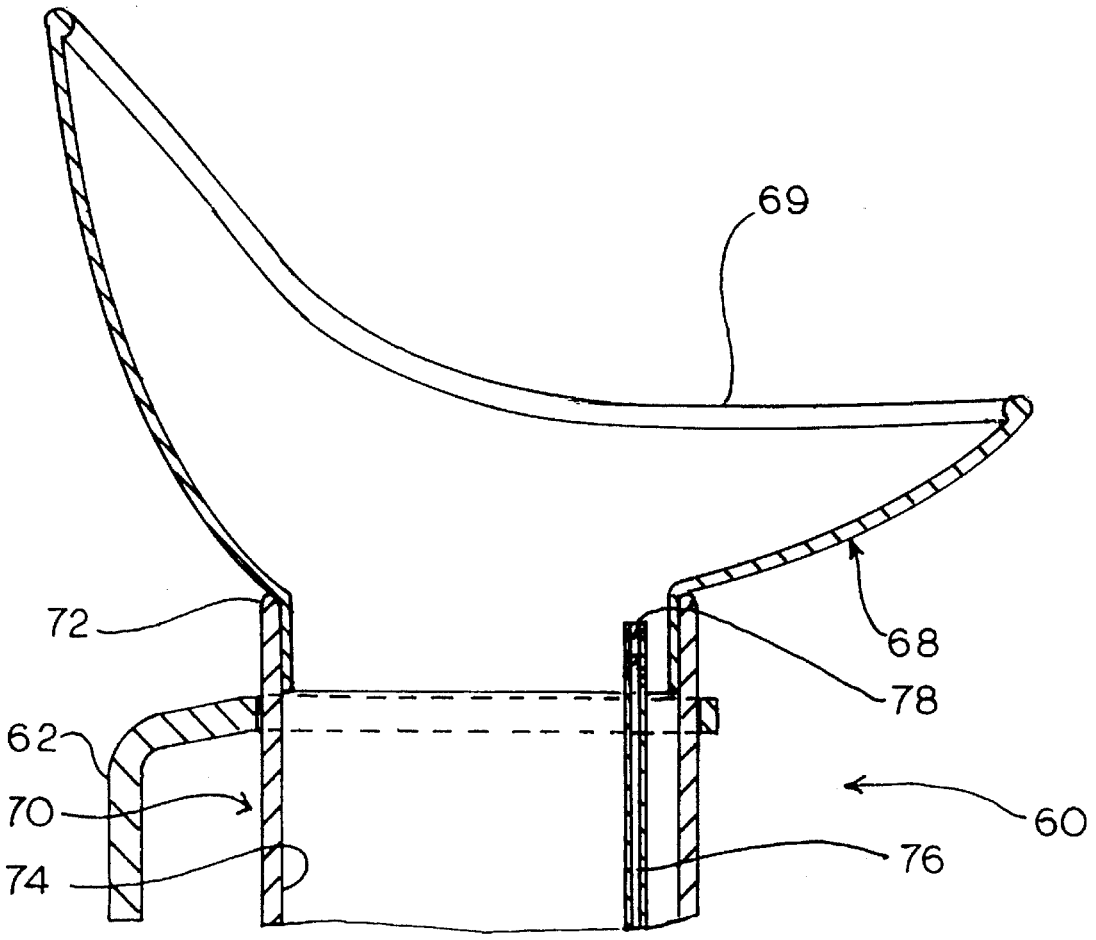
FIG. 5 shows a female adapter for the urine receptacle head.

Remote from the tank unit 12 is at least one receptacle head 60 for receiving urine. As shown in FIG. 4, the receptacle head 60 generally includes a hollow, cylindrical member 70 seated atop a molded base section 80. To aid in holding the receptacle head 60 during urination, a handle 62 is provided, and to prevent spills or splashing during flushing, a detachable cap 64 tops the cylindrical section. Like the flushing and waste tanks 20, 40, respectively, the cap 64 is vented by a vent opening 66, which in this embodiment includes a small tube 67 extending downwardly from the underside of the cap 64 to prevent waste from leaking out through the vent opening 66. To accommodate female users of the compact urinal system 10, a female adapter 68, shown in FIG. 5, mounts to the receptacle head 60 by snapping onto the inlet end 72 of the cylindrical member 70. Alternately, the receptacle head could be molded to accommodate female users without the need for the adapter 68. In any case, the female adapter 68 is formed with a softly curved upper edge 69 to provide more comfortable use. Like the male version of the receptacle head 60, the female version should also include a vented cap that fits securely around the upper edge 69 of the adapter 68 to prevent spills when flushing. The female version should also include a properly configured handle placed conveniently on the receptacle head to aid in secure placement during use.

The hollow cylindrical member 70 is preferably formed of a clear material such as plastic or glass so that the contents of the receptacle head 60 can be seen through the side walls 74 of the cylindrical member 70. The flushing line 30 carries flushing fluid 26 to a flushing nozzle 76 that extends upwardly from the base section 80 into the cylindrical member 70. At the top of the flushing nozzle 76, proximate the inlet end 72 of the cylindrical member 70, is a nozzle opening 78 that dispenses flushing fluid 26 into the receptacle head 60. Communicating with the receptacle head 60 in the bottom 82 of the base section 80 is the waste line 50, which drains flushing fluid and urine from the receptacle head 60 into the waste tank 40. The base section 80 includes a tapered portion 83 that gradually slopes toward the bottom 82 to funnel all of the waste into the waste line 50.

At least one illuminating device 84, such as a series of LED's or light bulbs, is mounted in the base section 80 for illuminating the contents of the receptacle head 60. Preferably, the illuminating device 84 emits a light only bright enough for one to properly use the system 10 during urination in an otherwise completely dark environment. To avoid overly awakening a sleepy user, the illuminating device 84 should not be excessively bright. An illuminating device switch 85 mounted on the exterior of the base section 80 is used to manually actuate the illuminating device 84.

To manually actuate the pump 32 and flush the system 10, a pump flush switch 86 is mounted on the base section 80 of the receptacle head 60. The flush switch 86 is electrically connected to the pump 32 by line 34. Preferably, the flush switch 86 and pump 32 are designed so that a single press of the flush switch 86 results in a predetermined volume of flushing fluid 26 being dispensed from the flushing nozzle 76 into the receptacle head 60. During operation of the system 10, the preferred method of use involves activating the illuminating device 84, urinating into the receptacle head 60, capping the receptacle head 60 with the vented cap 64, then flushing the system 10 by pressing the flush switch 86 to dispense flushing fluid 26 into the receptacle head 60. The urinal system 10 is designed to allow gravity to drain the waste 46 from the receptacle head 60 into the waste tank 40, although it is contemplated that a waste pump (not shown) could be provided to assist flushing.

Because the flushing tank 20 and the waste tank 40 are preferably made of an opaque material so that the contents thereof cannot be seen, the urinal system 10 of the invention provides a flushing fluid level indicator 88 and a waste level indicator 89 on the receptacle head 60. Float switch 22 in the flushing tank 20 is operably connected to the flushing fluid level indicator 88, and float switch 42 in the waste tank 40 is operably connected to the waste level indicator 89. Level indicators 88, 89 may be any conventional signaling mechanism, such as an LED or the like. When the waste tank 40 becomes full, drain line 54 may be opened to empty waste 46 from the waste tank 40 into an appropriate receptacle or facility.

Referring again to FIG. 1, the compact urinal system 10 shown therein includes a second receptacle head 90, which is desirable to allow two regular users of the system 10 to each have his/her own receptacle head for hygienic reasons. The second receptacle head 90 is preferably identical to the first receptacle head 60 and may be connected to the flushing tank 20 and waste tank 40 by entirely separate flushing and waste lines and a separate pump. Preferably, however, the second receptacle head 90 is connected to the flushing line 30 by a second flushing line 92 that joins flushing line 30 at a Y-valve 94. The flushing switches 86 on both receptacle heads 60, 90 may be wired to the Y-valve 94 to open the Y-valve 94 to the appropriate flushing line (30 or 92) leading to the receptacle head (60 or 90, respectively) being used.

Likewise, the second receptacle head 90 is preferably connected to the waste line 50 by a second waste line 96 that joins waste line 50 at a Y-connector 98.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A compact urinal system, comprising:

a) a flushing tank for storing a flushing fluid;

b) a waste tank;

c) a remote receptacle head having an illuminating device for receiving urine;

d) a flushing line interconnected between the receptacle head and the flushing tank for delivering flushing fluid from the flushing tank to the receptacle head;

e) a pump for pumping flushing fluid from the flushing tank, through the flushing line, and into the receptacle head;

a switch for actuating the pump; and g) a waste line for delivering urine and flushing fluid from the receptacle head to the waste tank.

2. The compact urinal system of claim 1 wherein the switch is mounted on the receptacle head.

3. The compact urinal system of claim 1 wherein the flushing tank and the waste tank together form a single tank unit.

4. The compact urinal system of claim 1 wherein the receptacle head includes a hollow, cylindrical member.

5. The compact urinal system of claim 4 wherein the receptacle head includes a flushing fluid nozzle proximate an inlet end of the cylindrical member for dispensing flushing fluid into the cylindrical member from the flushing line.

6. The compact urinal system of claim 4 wherein the hollow, cylindrical member is composed of a transparent material.

7. The compact urinal system of claim 1 wherein the receptacle head includes an inlet end and wherein the inlet end is provided with a female receptor disposed about the inlet end.

8. The compact urinal system of claim 1 further comprising a drain line for emptying the waste tank.

9. The compact urinal system of claim 1 further comprising a handle attached to the receptacle head.

10. The compact urinal system of claim 1 further comprising means for indicating a low flushing fluid level in the flushing tank.

11. The compact urinal system of claim 1 further comprising means for indicating that the waste tank is full.

12. The compact urinal system of claim 1 further comprising a second receptacle head connected to the flushing tank and the waste tank.

13. A compact urinal system, comprising:

a) a flushing tank for storing a flushing liquid;

b) a waste tank;

c) a hand-held urine receptacle head including an inlet end, side walls, and a bottom;

d) a flushing line open at one end in the flushing tank and open at another end in the receptacle head;

e) a pump associated with the flushing tank for pumping flushing fluid from the flushing tank, through the flushing line, and into the receptacle head;

f) a waste line for delivering urine and flushing liquid from the receptacle head to the waste tank g) a pump switch mounted on the hand-held receptacle head; and h) float switches disposed in the flushing tank and in the waste tank for detecting levels of fluid in the tank and fluid level indicators mounted on the hand-held receptacle head for indicating the levels of fluid in the tanks.

14. The compact urinal system of claim 13 further comprising an illuminating device and an illuminating device switch both mounted on the hand-held receptacle head.

15. The compact urinal system of claim 14 further comprising vents associated with both tanks.

16. The compact urinal system of claim 15 wherein the hand-held receptacle head includes a detachable cap that includes a vent opening.

17. The compact urinal system of claim 13 further comprising a second hand-held receptacle head attached by a second flushing line to the flushing tank and a second waste line to the waste tank.

18. A compact and sanitary automatic flushing urinal system comprising: a tank unit including two separate and distinct compartments, a flushing solution compartment and a waste compartment; a hand-held urine receptor connected to said tank unit via an elongated flexible line connector that extends between the tank unit and the hand-held receptor such that the hand-held urine receptor may be freely moved relative to the tank unit while still being communicatively connected to the tank unit; the flexible line connector extending between the hand-held urine receptor and the tank unit including at least two independent lines, a flushing line extending between the flushing compartment and the hand-held urine receptor and a waste line interconnected between the waste compartment and the hand-held urine receptor; a pump associated with the tank unit for pumping flushing solution from the flushing compartment through the flushing line into the hand-held urine receptor for flushing and cleaning the same; a pump switch mounted on the hand-held urine receptor for actuating the pump; wherein there is prodded a level switch associated with both the flushing compartment and the waste compartment of the tank unit and wherein there is provided a pair of level indicators on the hand-held urine receptor that are selectively actuated in response to the flushing solution falling below a predetermined level in the flushing tank and the waste level rising above a selected level in the waste tank; and wherein there is provided lighting means associated with the hand-held urine receptor for lighting the receptor.

* * * * *